United States Patent [19]

Burton et al.

[11] 4,285,666

[45] Aug. 25, 1981

[54] APPARATUS AND METHOD FOR INCREASING FUEL EFFICIENCY

[76] Inventors: Chester G. Burton, 8940 Tripoli Dr., Cincinnati, Ohio 45239; John H. Burton, 51 Kathryn Ave., Florence, Ky. 41042

[21] Appl. No.: 68,166

[22] Filed: Aug. 20, 1979

Related U.S. Application Data

[63] Continuation-in-part of Ser. No. 850,255, Nov. 10, 1977, abandoned.

[51] Int. Cl.[3] ..... F23D 13/12; F23D 19/00; F23D 13/14

[52] U.S. Cl. ..... 431/347; 431/7; 431/329

[58] Field of Search ..... 431/328, 329, 326, 7, 431/8, 347, 2

[56] References Cited

U.S. PATENT DOCUMENTS

| | | | |
|---|---|---|---|
| 1,167,446 | 1/1916 | Twomey | 431/347 |
| 1,659,221 | 2/1928 | Stanley | 431/329 |
| 2,362,972 | 11/1944 | Brownback | 431/347 |
| 3,085,402 | 4/1963 | Anderson | 431/347 |
| 3,245,459 | 4/1966 | Keith | 431/329 |
| 3,270,798 | 9/1966 | Ruff | 431/329 |
| 3,310,098 | 3/1967 | Hardison | 431/329 |
| 3,407,025 | 10/1968 | Hardison | 431/329 |
| 3,866,596 | 2/1975 | Gottwald | 431/329 |
| 3,925,001 | 12/1975 | Salooja | 431/347 |
| 4,047,877 | 9/1977 | Flanagan | 431/7 |

*Primary Examiner*—Samuel Scott
*Assistant Examiner*—G. Anderson
*Attorney, Agent, or Firm*—Frost & Jacobs

[57] ABSTRACT

A reticulated element positioned in the oxidizing zone of a flame in a combustion chamber adjacent the interface between the oxidizing and reducing regions of the flame, the element comprising a high temperature alloy base metal coated with platinum or platinum alloy. The efficiency of combustion of a hydrocarbon fuel is increased without increasing the level of carbon monoxide.

11 Claims, 5 Drawing Figures

APPARATUS AND METHOD FOR INCREASING FUEL EFFICIENCY

BRIEF SUMMARY OF THE INVENTION

This is a continuation-in-part of application Ser. No. 850,255 filed Nov. 10, 1977, now abandoned in the names of Chester G. Burton and John H. Burton.

This invention relates to apparatus and a method for increasing the efficiency of a hydrocarbon combustion process in a combustion chamber in which a flame is produced. More particularly, the apparatus has great utility in a furnace, water heater, steam boiler or the like in which a burner supplied with a gaseous hydrocarbon and oxygen-containing gas (ordinarily air) produces a flame which is used for heating purposes. The fuel may be a gaseous hydrocarbon such as natural gas (methane), bottled gas (propane), or normally liquid hydrocarbons which may be vaporized, atomized, or gasified. The term vaporized will be used hereafter to designate such a fuel source.

The present invention provides a reticulated element coated with a thin layer of catalytic material which is positioned in the oxidizing region of the flame in a combustion chamber adjacent the interface between the oxidizing and reducing regions of the flame, thereby increasing the rate of reduction and combustion efficiency without increasing the level of carbon monoxide or nitrogen oxides.

U.S. Pat. No. 3,407,025, to L. C. Hardison, discloses an infra-red heat producing apparatus comprising a non-catalytic first stage fuel gas combustion element which is an alloy metal screen, and a second stage catalytically active combustion element which is a gas pervious alloy metal screen of 20 to 70 mesh size coated with a platinum group metal or metals. At operating temperature no visible flame is generated, and the second stage catalytically active element acts as a "clean-up" stage for the gaseous mixture leaving the burner unit (column 4, lines 45–48). The spacing between the first stage and second stage combustion elements is defined only in terms of providing for "redistribution of unburned gases as well as combustion gases to the surface of the catalytically coated screen member" (column 5, lines 4–6). This spacing may vary from about $\frac{1}{8}$ to about 1 inch. There is no indication of the positioning of the second stage catalytic element relative to the primary and secondary zones of a gas flame. Since the flame has little or no visibility, positioning of the catalytic element in a particular zone of the flame would not be possible.

U.S. Pat. No. 3,925,001, to K. C. Salooja, discloses a catalytically active grid which is fixedly disposed in the primary reaction zone of a flame, the catalytically active material being chosen from a wide variety of compounds of combinations of metals including aluminum and platinum, zirconium and platinum, and palladium and iron. The catalytically active grid was in the form of a mesh of 1/16 inch thick wires forming rectangles of 1 inch by $\frac{1}{2}$ inch. Tests were conducted with the grid at various distances from the flame, and it was alleged that "a marked reduction in smoke and hence an improvement in fuel utilization is obtained by disposing the catalyst near the base of the flame . . . and in the region of the primary reaction zone of the flame" (column 7, lines 67–68, column 8, lines 1–3).

The use of catalyst devices for partial conversion of hydrocarbon fuel-air mixtures prior to combustion either in a combustion chamber or in an internal combustion engine has been the subject of considerable attention. Among the numerous patents relating to precombustion catalyst devices of various types, including reticulated members, reference may be made to U.S. Pat. Nos. 2,889,949; 3,682,608 and 3,885,539 issued to J. B. Hicks, U.S. Pat. Nos. 3,871,838 and 3,897,225 issued to H. J. Henkel, et al; and U.S. Pat. No. 3,922,136 issued to C. Koch.

It is of course well known that catalytic devices are now required in the exhaust systems of motor vehicles for conversion of combustion products such as carbon monoxide, light hydrocarbons and nitrogen oxides into harmless gases such as carbon dioxide and molecular nitrogen which can safely be discharged ionto the atmosphere.

U.S. Pat. No. 3,832,122, issued to P. G. LaHaye, et al. discloses a combustion device intended to reduce nitrogen oxides in its exhaust gas comprising a first combustion zone in which hydrocarbons are burned with insufficient air to oxidize completely all the carbon in the fuel. This results in formation of carbon monoxide and a relatively small amount of nitrogen oxides along with unburned hydrocarbons. These combustion products are then passed through a porous matrix or bed of refractory material into a second combustion chamber where a source of oxygen such as air is introduced to oxidize the unburned hydrocarbons and carbon monoxide to carbon dioxide and to convert the nitrogen oxides to molecular nitrogen.

The refractory bed of this patent may also include a catalyst to promote the reaction between carbon monoxide and nitrogen oxides. Suitable catalysts are stated to include "iron, nickel, chromium, copper and platinum as compounds or as alloys and mixtures thereof."

It is evident that such an arrangement requires precise control of the fuel-air ratios both in the first and second combustion chambers in order to avoid emission of exhaust gasses which could be even higher in dangerous combustions products than in a single combustion chamber in which stoichiometric fuel-air ratio conditions are used.

Despite the substantial amount of work done on precombustion catalyst devices and catalytic converters for exhaust systems, there have been no proposals, to the best of applicants' knowledge, which are simple to install and operate in either presently existing or newly constructed combustion chambers, and which will simultaneously increase the efficiency of a hydrocarbon combustion process while minimizing emission of harmful or toxic combustion products such as carbon monoxide and unburned hydrocarbons in the exhaust gases. In fact, the catalytic emission control systems of motor vehicles are known to decrease the efficiency thereof.

It is a principal object of the present invention to provide apparatus and a method for increasing the efficiency of combustion of gaseous or vaporized hydrocarbon fuel by increasing the reaction rate to obtain substantially complete combustion within the reaction chamber, thereby concentrating the heat produced within that chamber and minimizing harmful combustion products in the exhaust gases leaving the chamber.

According to the invention, apparatus is provided for achieving the above object, comprising a combustion chamber in which a flame is produced, a burner extending into the chamber for introduction of a gaseous or vaporized hydrocarbon fuel and oxygen-containing gas into the chamber, means for supplying the hydrocarbon fuel and oxygen-containing gas to the burner, a single stage reticulated element comprising a high temperature alloy support coated with platinum or platinum alloys, and means for adjustably positioning the reticulated element in the oxidizing region of the flame adjacent the interface between the oxidizing and reducing regions thereof.

The method of increasing the efficiency of combustion of gaseous or vaporized hydrocarbon fuel in a flame, in accordance with the present invention, comprises positioning a single stage reticulated element in the oxidizing region of the flame adjacent the interface between the oxidizing and reducing regions thereof, the reticulated element comprising a high temperature alloy support coated with a metal catalyst chosen from the group consisting of platinum, and platinum alloys, and presenting sufficient catalyst surface to spread the interface between the oxidizing and reducing regions of the flame and to increase the combustion efficiency by at least 10%.

When the fuel is natural gas, the method of the invention will increase the carbon dioxide content of the products of combustion to greater than 11% by volume (the theoretical maximum being 12.2% by volume in a standard test furnace), and the carbon monoxide content will be restricted to less than 0.02% by volume, as shown by test results reported hereinafter.

In a preferred embodiment, wherein a flame is produced in a furnace chamber by combustion of a gaseous or vaporized hydrocarbon fuel in the presence of oxygen-containing gas, the improvement of the present invention comprises a reticulated element positioned in the oxidizing zone of the flame adjacent the interface between the oxidizing and reducing zones thereof, the reticulated element comprising a high temperature alloy support coated with platinum, the platinum coating having a thickness of about $2.5\times10^{-7}$ to about $5\times10^{-7}$ mm (about $1.0\times10^{-8}$ to $2.0\times10^{-8}$ inch).

The expression "high temperature alloy" is a term having a recognized meaning in the metallurgical art as including nickel-base alloys and stainless steel alloys which exhibit high strength, oxidation resistance and scale resistance at a temperature of at least about 815° C. It has been found that platinum can be electrolytically deposited on a wire screen formed of a nickel-base alloy having openings ranging between 0.25 and 0.84 mm in a very thin coating within the ranges set forth above, to provide a reticulated element which is not only highly effective in increasing the efficiency of hydrocarbon combustion but which is also substantially unaffected by the heat of combustion over extended periods of time.

BRIEF DESCRIPTION OF THE DRAWING

Reference is made to the accompanying drawing wherein.

DETAILED DESCRIPTION

Figure 2:
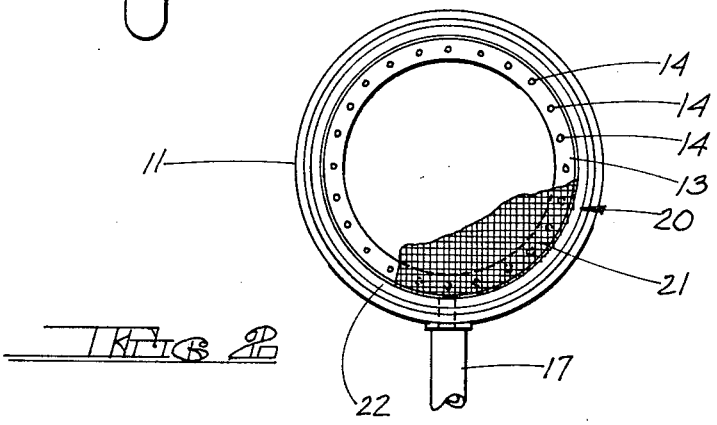
FIG. 2 is a sectional view taken on the line 2—2 of FIG. 1.

Referring to the drawing, a furnace is shown generally at 10 comprising a side wall 11 which defines a combustion chamber 12. As will be apparent from FIG. 2 side wall 11 is cylindrical thus providing a circular combustion chamber. However, it will be understood that the configuration may also provide a square or rectangular combustion chamber.

A burner is shown at 13 which in the illustrated embodiment is round and is provided with a plurality of equally spaced openings 14 in conventional manner, through which a combustible mixture of fuel and oxygen-containing gas passes. When ignited, a flame is produced at each outlet 14.

Figure 1:
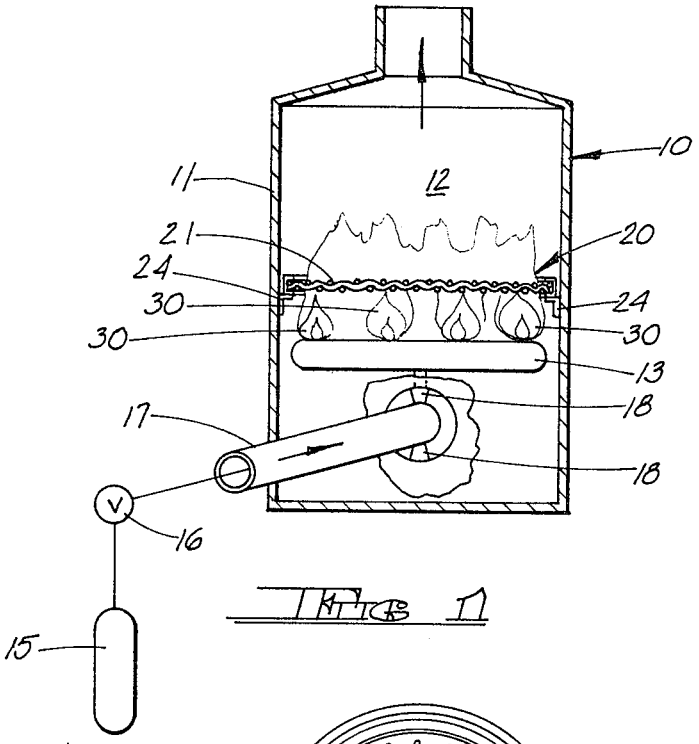
FIG. 1 is a vertical sectional view of a furnace embodying the present invention.

Means for supplying a hydrocarbon fuel are indicated schematically in FIG. 1, as a tank 15 supplying gas through a regulator valve 16 to supply line 17.

The burner head is of conventional construction and includes quadrants 18 through which air is drawn in and mixed with a gaseous fuel passing through line 17. As is well known, the size of the quadrant openings 18 may be varied to regulate the fuel:air ratio. In the apparatus of the present invention it is preferred to operate at stoichiometrically equivalent fuel:air ratios. However, as will be shown hereinafter, improved efficiency is obtained even when the amount of air mixed with the fuel is insufficient for complete combustion.

A reticulated element in accordance with the invention is shown generally at 20. This element comprises a wire screen 21 formed of an alloy having high strength, oxidation resistance and scale resistance at a temperature of at least about 815° C. The perimeter of the screen 21 is secured by a rim 22 which is preferably of the same high temperature alloy as the wire screen, in order to maintain the screen in a generally planar configuration. In the illustrated embodiment the rim 22 is circular, but it will be understood that it could be rectangular or square in the case of ribbon-type burners.

Figure 3:
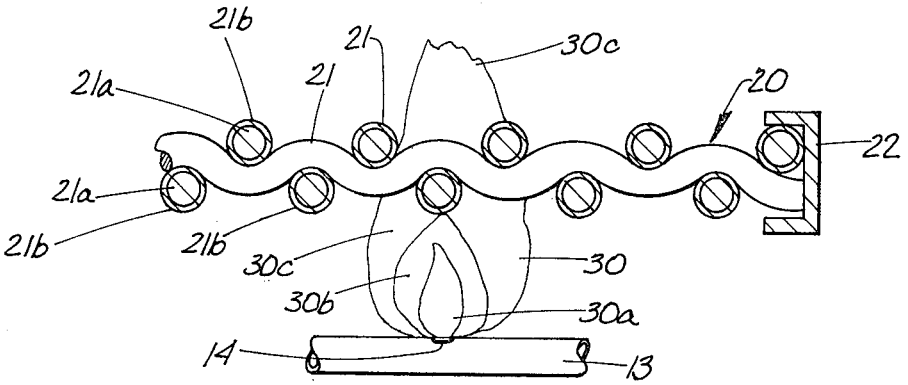
FIG. 3 is a vertical sectional view on an enlarged scale of a portion of the apparatus of FIG. 1.

Flames produced by burning of the combustible fuel and oxygen-containing gas mixture are shown at 30. As best seen in FIG. 3, each flame, issuing from opening 14, comprises a light blue conical region **30*a* of unburned gas and air, a blue region or zone 30*b* which is reducing since complete combustion has not yet occurred, and an oxidizing region or zone 30*c*** in which the maximum temperature is reached.

Figure 4:
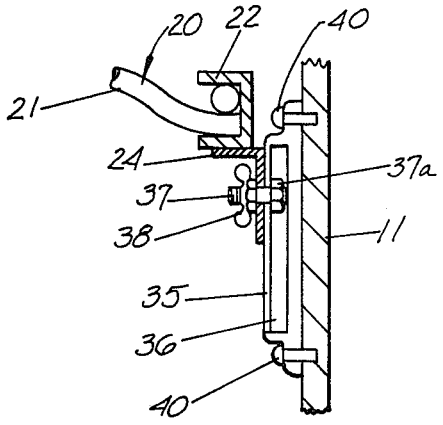
FIG. 4 is a fragmentary vertical sectional view showing an embodiment of the invention.
Figure 5:
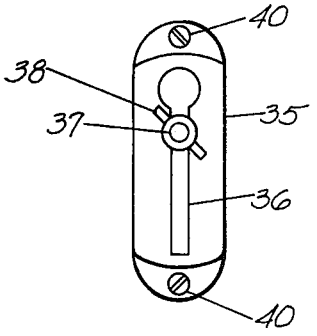
FIG. 5 is a plan view of the embodiment of FIG. 4.

Means are provided for adjustment of the height of the reticulated element 20 relative to the burner 13 so as to ensure that the catalyst coated screen 21 is positioned in the oxidizing region **30*c* of the flame adjacent the interface between the oxidizing region and reducing region 30*b* thereof. Exemplary adjustment means, illustrated in FIGS. 4 and 5, comprise a vertically oriented retainer 35 having an elongated bayonet slot 36 in which a threaded bolt 37 is slidably engaged. Bolt 37 is provided with a head 37*a* which passes through the enlarged portion of bayonet slot 36 and is retained against withdrawal from the narrow portion of the slot. Bracket 24 is provided with an aperture in the vertically oriented leg thereof through which the free end of bolt 37 passes with clearance. A wing nut 38, or equivalent clamping means, is threadably engaged on the free end of bolt 37, and tightening of the nut 38 clamps bracket 24 against retainer 35, thereby frictionally holding bracket 24 in a desired position of vertical adjustment. Retainer 35 is secured against the wall 11 of the combustion chamber by means of threaded screws 40**, spot welding, or other conventional means.

For a cylindrical combustion chamber, it will be understood that three equidistantly spaced retainers 35 and associated brackets 24, bolts 37 and nuts 38 would suffice, whereas for a square or rectangular combustion chamber the adjustment means are preferably provided on each of the four walls.

Other equivalent adjustment means are considered to be within the scope of the invention. Moreover, it is not considered a departure to adjust the fuel flow rate and consequent height of the flame, to ensure that screen 21 is positioned in the oxidizing region of the flame adjacent the interface between the oxidizing and reducing portions thereof. Accordingly, the term "means for adjustably positioning the reticulated element" as used herein, is to be construed broadly enough as to cover the various alternatives set forth above.

It is a critical feature of the present invention that the wire screen 21 be positioned in the oxidizing region or zone of the flame at or near the interface between the oxidizing and reducing regions. The mesh openings should also be of sufficient size to permit the flame to be sustained on the side of the screen opposite from the burner 13, as shown in FIG. 3. Accordingly, the finest screen size which can be used is about 60 mesh. U.S. Standard Sieve Series, which provides screen openings of about 0.25 mm ($9.8\times10^{-3}$ inch). Openings smaller than this would not permit the flame to be sustained and would also result in excessive pressure drop through the furnace. On the other hand, the screen size cannot be so coarse as to present insufficient surface area for the catalyst coating thereon to function efficiently. For this reason the coarsest screen size is about 20 mesh, U.S. Standard Sieve Series, having openings of about 0.84 mm ($3.3\times10^{-2}$ inch). Excellent results have been obtained using 40 mesh screen, U.S. Standard Sieve Series, having openings of 0.42 mm ($1.65\times10^{-2}$ inch).

In the U.S. Standard Sieve Series the wire diameter for 20 mesh screen is 0.38 to 0.55 mm; for 40 mesh the wire diameter is 0.23 to 0.33 mm; while for 60 mesh the wire diameter is 0.149 to 0.220 mm.

Although not wishing to be bound by theory, it is believed that the range of screen sizes found to be operative in the present invention produces a very slight pressure drop across the flame at the interface between the oxidizing and reducing regions thereof, thus spreading and probably extending the interface and thereby increasing the time that the fuel and oxygen are in contact with the catalyst surface. An increase of at least 10%, and up to almost 40% in combustion efficiency is thereby achieved.

The requirements for the alloy from which the wire screen is made are that it be capable of being drawn into wire within the diameter ranges set forth above, that the alloy have high strength, good oxidation resistance and good scale resistance at a temperature of at least about 815° C. (1500° F.), and that after suitable surface preparation an electrolytically deposited thin coating of platinum or platinum alloy exhibit good adherence thereto. Excellent results have been obtained with the high temperature alloy Inconel 600 having a nominal composition of 0.04% carbon, 0.2% manganese, 0.2% silicon, 15.5% chromium, 76.0% nickel, and balance iron with incidental impurities, all percentages being by weight. Other alloys meeting the above requirements include Inconel Alloy 722, Nickelvac 600, AMS 5388 and RA-634. Other high temperature alloys of at least 50% nickel and stainless steel alloys which may be suitable are disclosed in "Metal Selector", by the Penton Publishing Company, in the section entitled "High Temperature Alloys".

As shown in FIG. 3, the reticulated element 20 comprises a wire screen formed of high temperature alloy 21*a* having a platinum coating 21*b* which is preferably deposited thereon by electrocoating. Platinum alloys which can be deposited by electrocoating may also be used, e.g., platinum-iridium alloy. Due to the high cost of platinum, it is of course desirable to deposit an extremely thin coating, and it has been found that a platinum coating of about $2.5\times10^{-7}$ mm ($1.0\times10^{-8}$ inch) gives excellent results. For assured long life and heavy duty applications, a coating up to about $5\times10^{-7}$ mm in thickness ($2.0\times10^{-8}$ inch) may be used. A 40 mesh wire screen formed of Inconel Alloy 600 electroplated with a coating of platinum to a thickness of about $2.5\times10^{-7}$ mm can be produced at a cost which is readily affordable even by low and middle income families.

A series of American Gas Association standard tests was conducted in a central standard furnace manufactured by The Williamson Company (Z21.47) in which the reticulated element of the present invention was installed. The reticulated element was a 40 mesh (U.S. Standard Sieve Series) wire screen formed of Iconel Alloy 600 with an electrolytically deposited platinum coating of about $2.5\times10^{-7}$ mm thickness. In conducting these tests, the carbon dioxide and carbon monoxide contents of the exhaust gases were analyzed, and the heat exchanger skin temperature was also monitored. When using natural gas as fuel, a carbon dioxide concentration of 12.2% represented maximum combustion efficiency in the test furnace. Under standards established by the American Gas Association, the maximum amount of carbon monoxide permissible in exhaust gases is 0.04%. The test results are set forth in Table I.

In Table I a Standard run (without restriction of incoming air and exhaust gases) is first reported without the reticulated element of the present invention, for purposes of comparison. Tests 1–4 were conducted with the reticulated element positioned about 5 inches above the ribbon burner tops in the oxidizing regions of the flames adjacent the interface between the oxidizing and reducing regions, just above the blue flame area. In test 1 there was no restriction on the incoming air or outgoing exhaust gases. In tests 2 and 3 the amount of incoming air was restricted by ½ inch and 1 inch respectively, while in test 4 the incoming air was restricted by 1¼ inch, and the exhaust or flue gases were also blocked.

In test 1, the increase in carbon dioxide content of the exhaust gas over that of the standard run represented an improvement of about 11.6% in combustion efficiency. It is further significant to note that the carbon monoxide content remained at the low level of 0.004%. In test 2, the increase in carbon dioxide content to 11.30% represented an improvement of about about 31.4% with the carbon monoxide level remaining the same. In test 3 the further increase in carbon dioxide content to 11.57% represented an improvement of 34.5% in efficiency, with the carbon monoxide increase being relatively insignificant.

Test 4 represented operation under abnormal conditions in order to ascertain whether any safety hazards might result from insufficient air supply and accidental blocking of the flow of exhaust gases. It will be noted that the carbon dioxide content increased still further to 11.92% representing an improvement in efficiency of about 38.6%. Although the carbon monoxide level increased appreciably, it is significant that it was still less than half that permitted by the American Gas Association standard.

For further comparison the reticulated element was removed, and the inlet air was restricted by 1½ inch, without blocking the outlet. This is reported in Table I as Standard-restricted 1¼". It will be noted that the carbon dioxide level was somewhat lower than those of Tests 3 and 4.

Finally, it was noted that normal operating furnace temperature was reached in 5–6 minutes of operation with the reticulated element of the present invention, whereas about 15 minutes was required to attain normal operating temperature without the reticulated element.

Examination of the coated wire screen at the conclusion of the tests summarized in Table I indicated no scaling or spalling of the platinum catalyst coating, and no apparent damage to the Inconel Alloy 600 screen base.

Temperature readings taken in the heat exchanger skin and in the exhaust gas flue of the test furnace showed that the heat exchanger skin was close to the allowable maximum of 490° C. and that the exhaust gas temperatures were about 25° C. lower in the exhaust flue in Tests 1–4 than in the Standard test, thus indicating concentration of a greater part of the heat of reaction in the furnace chamber itself, due to the more rapid rate of combustion.

TABLE I

| Test No. | Volume % CO | Volume % $CO_2$ |
|---|---|---|
| Standard-unrestricted (without screen) | 0.004 | 8.60 |
| 1 - unrestricted | 0.004 | 9.60 |
| 2 - restricted ½" | 0.004 | 11.30 |
| 3 - restricted 1" | 0.007 | 11.57 |
| 4 - restricted 1¼" blocked flue | 0.018 | 11.92 |
| Standard - restricted 1¼" (without screen) | 0.007 | 11.23 |

It is therefore evident that the reticulated element of the present invention provides a marked increase in the efficiency of fuel combustion, that its effectiveness is automatic and is not impaired under widely varying operating conditions, and that it is simple to install. The reticulated element can be used both in new installations and in combustion chambers of existing furnaces, hot water heaters, steam boilers and the like which use natural gas, bottled gas, or fuel oils which is vaporized or atomized. It will of course be understood that suitable fuel oil supply nozzles and burners may be substituted for the gas burner described above.

As indicated above, the use of platinum alloys as a catalytic coating is considered to be within the scope of the present invention, the only problem in such use being electrolytic deposition of an alloy coating. Preliminary tests have indicated that a platinum-iridium coating is less susceptible to catalyst poisoning (e.g., by sulfur in the fuel) and corrosion (e.g., by chlorides) than pure platinum.

It will be understood that modifications may be made in the described apparatus without departing from the spirit and scope of the invention. For example, while the burner and reticulated element have been illustrated as being positioned in a substantially horizontal plane, it is evident that the burner and reticulated element could be positioned in an inclined or vertical position if required by a particular furnace design. Although it is preferred that the reticulated element be of sufficient size relative to the burner surface to extend to the outer extremities of the flames issuing therefrom, the benefits of the invention are nevertheless achieved under conditions where the flames lap outwardly around the perimeter of the reticulated element.

What we claim is:

1. Apparatus for increasing the efficiency of a furnace utilizing hydrocarbon fuel, comprising a combustion chamber in which a flame is produced, a burner extending into said chamber for introduction of a gaseous or vaporized hydrocarbon fuel and oxygen-containing gas into the chamber, means for supplying said hydrocarbon fuel and oxygen-containing gas to said burner, a single stage generally planar reticulated element comprising a high temperature alloy support coated with a platinum-containing catalyst, and means for adjustably positioning said reticulated element relative to said burner in the oxidizing region of said flame adjacent the interface between the oxidizing and reducing regions thereof.

2. The apparatus claimed in claim 1, wherein said reticulated element is a wire screen having openings ranging between about 0.25 and 0.84 mm on which is deposited a platinum coating ranging from about $2.5\times10^{-7}$ to about $5\times10^{-7}$ mm in thickness.

3. The apparatus claimed in claim 1, wherein said reticulated element is a wire screen formed of a high temperature alloy comprising at least about 50% by weight nickel.

4. The apparatus claimed in claim 1, wherein said reticulated element is a wire screen formed of an alloy having high strength, oxidation resistance and scale resistance at a temperature of at least about 815° C.

5. In a furnace chamber having a flame produced by combustion of a gaseous or vaporized hydrocarbon fuel in the presence of oxygen-containing gas, the improvement which comprises a single stage generally planar reticulated element adjustable relative to said flame whereby to permit positioning of said reticulated element in the oxidizing zone of said flame adjacent the interface between the oxidizing and reducing zones thereof, said reticulated element comprising a high temperature alloy support coated with a platinum-containing catalyst, said coating having a thickness of about $2.5\times10^{-7}$ mm to about $5\times10^{-7}$ mm.

6. The improvement claimed in claim 5, wherein said high temperature alloy support is a wire screen having openings ranging between about 0.25 and 0.84 mm.

7. The improvement claimed in claim 6, wherein said wire screen is formed of an alloy having high strength, oxidation resistance and scale resistance at a temperature of at least about 815° C.

8. The improvement claimed in claim 6, wherein said wire screen is formed of a high temperature alloy comprising at least about 50% by weight nickel.

9. The improvement claimed in claim 5, wherein said coating is platinum formed by electrolytic deposition.

10. A method of increasing the efficiency of combustion of gaseous or vaporized hydrocarbon fuel in a flame, which comprises positioning a single stage generally planar reticulated element in the oxidizing region of said flame adjacent the interface between the oxidizing and reducing regions thereof, said reticulated element comprising a high temperature alloy support coated with a platinum-coating catalyst and presenting sufficient catalyst surface to spread said interface between the oxidizing and reducing regions of said flame and to increase the combustion efficiency by at least 10%.

11. The method claimed in claim 10, wherein said fuel is natural gas, wherein the carbon dioxide content of the products of combustion is increased to greater than 11% by volume, and wherein the carbon monoxide content is less than 0.02% by volume.

* * * * *